US011021771B2

(12) United States Patent
Yashiki et al.

(10) Patent No.: US 11,021,771 B2
(45) Date of Patent: Jun. 1, 2021

(54) NON-ORIENTED ELECTRICAL STEEL SHEET AND METHOD FOR MANUFACTURING NON-ORIENTED ELECTRICAL STEEL SHEET

(71) Applicant: NIPPON STEEL CORPORATION, Tokyo (JP)

(72) Inventors: Hiroyoshi Yashiki, Tokyo (JP); Yoshiaki Natori, Tokyo (JP); Kazutoshi Takeda, Tokyo (JP); Susumu Mukawa, Tokyo (JP); Takuya Matsumoto, Tokyo (JP); Koji Fujita, Tokyo (JP); Takashi Morohoshi, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 69 days.

(21) Appl. No.: 16/470,078

(22) PCT Filed: Jan. 16, 2018

(86) PCT No.: PCT/JP2018/000974
§ 371 (c)(1),
(2) Date: Jun. 14, 2019

(87) PCT Pub. No.: WO2018/131710
PCT Pub. Date: Jul. 19, 2018

(65) Prior Publication Data

US 2019/0316221 A1 Oct. 17, 2019

(30) Foreign Application Priority Data

Jan. 16, 2017 (JP) ..... JP2017-005213

(51) Int. Cl.
*C21D 9/46* (2006.01)
*C21D 8/12* (2006.01)
(Continued)

(52) U.S. Cl.
CPC ..... *C21D 9/46* (2013.01); *C21D 6/008* (2013.01); *C21D 8/1222* (2013.01);
(Continued)

(58) Field of Classification Search
CPC ..... C21D 6/008; C21D 8/12; C21D 8/1222; C21D 8/1233; C21D 8/1261;
(Continued)

(56) References Cited

U.S. PATENT DOCUMENTS 5,803,988 A 9/1998 Bae et al.
2002/0066500 A1* 6/2002 Kawano ..... C21D 8/1272 148/111
(Continued)

FOREIGN PATENT DOCUMENTS

DE 196 81 215 T1 4/1998
JP 2000-160306 A 6/2000
(Continued)

OTHER PUBLICATIONS

"Methods of measurement of the magnetic properties of magnetic steel sheet and strip by means of a single sheet tester", JIS C2556, 1996, total 254 pages. "Test methods for electrical steel strip and sheet", Jis C2550, 2011, total 477 pp.. International Search Report for PCT/JP2018/000974 mailed on Apr. 24, 2018. Notice of Allowance for Tw 107101550 mailed on Sep. 14, 2018. Written Opinion of the International Searching Authority for PCT/JP2018/000974 (PCT/Isa/237) mailed on Apr. 24, 2018.
(Continued)

*Primary Examiner* — Jenny R Wu
(74) *Attorney, Agent, or Firm* — Birch, Stewart, Kolasch & Birch, LLP

(57) ABSTRACT

A non-oriented electrical steel sheet contains, as a chemical composition, by mass %, C: more than 0% and 0.0050% or less, Si: 3.0% to 4.0%, Mn: 1.0% to 3.3%, P: more than 0%
(Continued)

and less than 0.030%, S: more than 0% and 0.0050% or less, sol. Al: more than 0% and 0.0040% or less, N: more than 0% and 0.0040% or less, O: 0.0110% to 0.0350%, Sn: 0% to 0.050%, Sb: 0% to 0.050%, Ti: more than 0% and 0.0050% or less, and a remainder including Fe and impurities, in which Sn+Sb: 0.050% or less, Si−0.5×Mn: 2.0% or more, and an O content in a sheet thickness central portion excluding a surface layer portion which is a range from a front surface and a rear surface to a position of 10 μm in a depth direction is less than 0.0100%.

2 Claims, 2 Drawing Sheets

(51) Int. Cl.

| | |
|---|---|
| ***C21D 6/00*** | (2006.01) |
| ***C22C 38/60*** | (2006.01) |
| ***C22C 38/14*** | (2006.01) |
| ***C22C 38/06*** | (2006.01) |
| ***C22C 38/00*** | (2006.01) |
| ***H01F 1/16*** | (2006.01) |
| ***C22C 38/04*** | (2006.01) |

(52) U.S. Cl.
CPC ..... *C21D 8/1261* (2013.01); *C21D 8/1272* (2013.01); *C22C 38/001* (2013.01); *C22C 38/002* (2013.01); *C22C 38/008* (2013.01); *C22C 38/04* (2013.01); *C22C 38/06* (2013.01); *C22C 38/14* (2013.01); *C22C 38/60* (2013.01); *C22C 2202/02* (2013.01)

(58) Field of Classification Search
CPC .... C21D 8/1272; C21D 9/46; C22C 2202/02; C22C 38/00; C22C 38/001; C22C 38/002; C22C 38/008; C22C 38/04; C22C 38/06; C22C 38/14; C22C 38/60; H01F 1/147
See application file for complete search history.

(56) References Cited

U.S. PATENT DOCUMENTS

| | | | | |
|---|---|---|---|---|
| 2012/0014828 | A1* | 1/2012 | Miyazaki | C22C 38/08 420/40 |
| 2016/0201154 | A1 | 7/2016 | Tomokiyo et al. | |
| 2017/0229222 | A1 | 8/2017 | Nakanishi et al. | |
| 2017/0241002 | A1 | 8/2017 | Nakajima et al. | |
| 2017/0314090 | A1 | 11/2017 | Okubo et al. | |
| 2018/0030558 | A1 | 2/2018 | Okubo et al. | |

FOREIGN PATENT DOCUMENTS

| | | | | |
|---|---|---|---|---|
| JP | 2000160306 | A | * | 6/2000 |
| JP | 2000-256751 | A | | 9/2000 |
| JP | 2000256751 | A | * | 9/2000 |
| JP | 2015-206092 | A | | 11/2015 |
| JP | 2016-41832 | A | | 3/2016 |
| JP | 2016-130360 | A | | 7/2016 |
| JP | 2016-138316 | A | | 8/2016 |
| JP | 2016-145376 | A | | 8/2016 |
| KR | 10-2014-0084896 | A | | 7/2014 |
| TW | 201525156 | A | | 7/2015 |
| TW | 201612329 | A | | 4/2016 |
| TW | 201615860 | A | | 5/2016 |
| TW | 201631181 | A | | 9/2016 |
| WO | WO 2016/027565 | A1 | | 2/2016 |

OTHER PUBLICATIONS

"Test methods for electrical steel strip and sheet", JIS C2550, 2011, total 477 pages.
International Search Report for PCT/JP2018/000974 dated Apr. 24, 2018.
Notice of Allowance for TW 107101550 dated Sep. 14, 2018.
Written Opinion of the International Searching Authority for PCT/JP2018/000974 (PCT/ISA/237) dated Apr. 24, 2018.
Extended European Search Report for European Application No. 18739320.2, dated May 4, 2020.

* cited by examiner

NON-ORIENTED ELECTRICAL STEEL SHEET AND METHOD FOR MANUFACTURING NON-ORIENTED ELECTRICAL STEEL SHEET

TECHNICAL FIELD OF THE INVENTION

The present invention relates to a non-oriented electrical steel sheet and a method for manufacturing a non-oriented electrical steel sheet.

Priority is claimed on the basis of Japanese Patent Application No. 2017-005213 filed in Japan on Jan. 16, 2017, the content of which is incorporated herein by reference.

RELATED ART

Recently, global environment issues have been gaining attention, and a demand for efforts for energy saving has been further intensifying. Particularly, in recent years, there has been a strong demand for an increase in efficiency of electrical devices. Therefore, for non-oriented electrical steel sheets that are broadly used as iron core materials of motors, power generators, transformers, or the like, a demand for improving magnetic properties has been further intensifying. In recent years, for motors, power generators for electrical vehicles, or hybrid vehicles, and motors for compressors for which an increase in efficiency progresses, the above-described tendency is significant.

In order to improve the magnetic properties of the non-oriented electrical steel sheets, it is effective to add alloying elements to steel, thereby increasing electrical resistance of steel sheets and decreasing eddy-current loss. Therefore, for example, as disclosed in Patent Document 1 to Patent Document 3, the improvement of the magnetic properties (a decrease in iron loss, an increase in density of magnetic flux, and the like) is achieved by adding an element having an effect of increasing electrical resistance such as Si, Al, Mn, or P.

PRIOR ART DOCUMENT

Patent Document

[Patent Document 1] PCT International Publication No. WO2016/027565

[Patent Document 2] Japanese Unexamined Patent Application, First Publication No. 2016-130360

[Patent Document 3] Japanese Unexamined Patent Application, First Publication No. 2016-138316

DISCLOSURE OF THE INVENTION

Problems to be Solved by the Invention

Here, in a case where it is considered the alloying elements in the same amount (mass %) is added, except for P having a significant adverse influence on cold rollability, Si is an effective element for easily increasing the electrical resistance and decreasing the iron loss. Therefore, Patent Document 1 discloses that Si content is set to 6 mass % or less, Patent Document 2 and Patent Document 3 disclose that the Si content is set to 5.0 mass % or less. In addition, Patent Document 1 to Patent Document 3 disclose that Al content is set to 0.0050% or less, and the electrical resistance is increased using Si or using Si and Mn, thereby decreasing the iron loss.

However, as a result of studies, the inventors found that a decrease in a high-frequency iron loss (improvement) such as $W_{10/400}$ is not sufficient, in the steel sheets described in Patent Document 1 to Patent Document 3. The reason therefor is considered that high alloying is indispensable to decrease the high-frequency iron loss; however, in Patent Document 1 to Patent Document 3, the high-frequency iron loss is not studied, and the lower limit values of amounts of alloys necessary for the decrease in the high-frequency iron loss or a distribution of appropriate amounts of Si, Al, and Mn are not taken into account. Therefore, the decrease in the high-frequency iron loss such as $W_{10/400}$ is not sufficient.

The present invention has been made in consideration of the above-described problem. An object of the present invention is to provide a non-oriented electrical steel sheet which has favorable cold rollability and is excellent in magnetic properties, particularly, high-frequency iron loss and a method for manufacturing a non-oriented electrical steel sheet.

Means for Solving the Problem

In order to achieve the above-described object, the present inventors carried out intensive studies. As a result, the present inventors found that magnetic properties can be improved while ensuring favorable cold rollability by (i) setting the Al content to be equal to or less than a predetermined value and (ii) adding Mn which contributes to an increase in electrical resistance and has a small adverse influence on cold rollability together with Si.

In addition, in order to further improve the cold rollability, it is necessary to decrease the amounts of P, Sn, and Sb which are likely to cause the degradation of the cold rollability. On the other hand, the present inventors also found that nitriding during final annealing is accelerated, and there is a possibility that the magnetic properties may be degraded, when the amounts of Sn and Sb are decreased. On the basis of the above-described finding, as a result of carrying out additional studies, the present inventors found a method capable of further improving cold rollability without causing the degradation of magnetic properties even in a case where the amounts of Sn and Sb are decreased, and completed the present invention.

The gist of the present invention completed on the basis of the above-described finding is as described below.

(1) A non-oriented electrical steel sheet according to an aspect of the present invention contains, as a chemical composition, by mass %, C: more than 0% and 0.0050% or less, Si: 3.0% to 4.0%, Mn: 1.0% to 3.3%, P: more than 0% and less than 0.030%, S: more than 0% and 0.0050% or less, sol. Al: more than 0% and 0.0040% or less, N: more than 0% and 0.0040% or less, O: 0.0110% to 0.0350%, Sn: 0% to 0.050%, Sb: 0% to 0.050%, Ti: more than 0% and 0.0050% or less, and a remainder including Fe and impurities, in which Sn+Sb: 0.050% or less, Si−0.5×Mn: 2.0% or more, and an O content in a sheet thickness central portion excluding a surface layer portion which is a range from a front surface and a rear surface to a position of 10 μm in a depth direction is less than 0.0100%.

(2) A method for manufacturing a non-oriented electrical steel sheet according to another aspect of the present invention includes: hot rolling a steel ingot including, as a chemical composition, by mass %, C: more than 0% and 0.0050% or less, Si: 3.0% to 4.0%, Mn: 1.0% to 3.3%, P: more than 0% and less than 0.030%, S: more than 0% and 0.0050% or less, sol. Al: more than 0% and 0.0040% or less, N: more than 0% and 0.0040% or less, O: less than 0.0100%, Sn: 0% to 0.050%, Sb: 0% to 0.050%, Ti: more than 0% and 0.0050% or less, and a remainder including Fe and impurities, Sn+Sb: 0.050% or less, Si−0.5×Mn: 2.0% or more to produce a hot-rolled steel sheet, annealing the hot-rolled steel sheet, cold rolling the hot-rolled steel sheet after the annealing hot-rolled sheet to produce a cold-rolled steel sheet, and final annealing the cold-rolled steel sheet, in which, in the final annealing, a final annealing condition is controlled so that an average O content in the entire cold-rolled steel sheet in a sheet thickness direction after the final annealing becomes 0.0110 mass % to 0.0350 mass %.

(3) In the method for manufacturing a non-oriented electrical steel sheet according to (2), in the final annealing, a dew point of an atmosphere during temperature rising and during soaking may be controlled so as to be in a range of −10° C. to 40° C.

Effects of the Invention

According to the above-described aspects of the present invention, a non-oriented electrical steel sheet having favorable cold rollability and excellent magnetic properties and a manufacturing method therefor can be obtained.

EMBODIMENTS OF THE INVENTION

Figure 1:
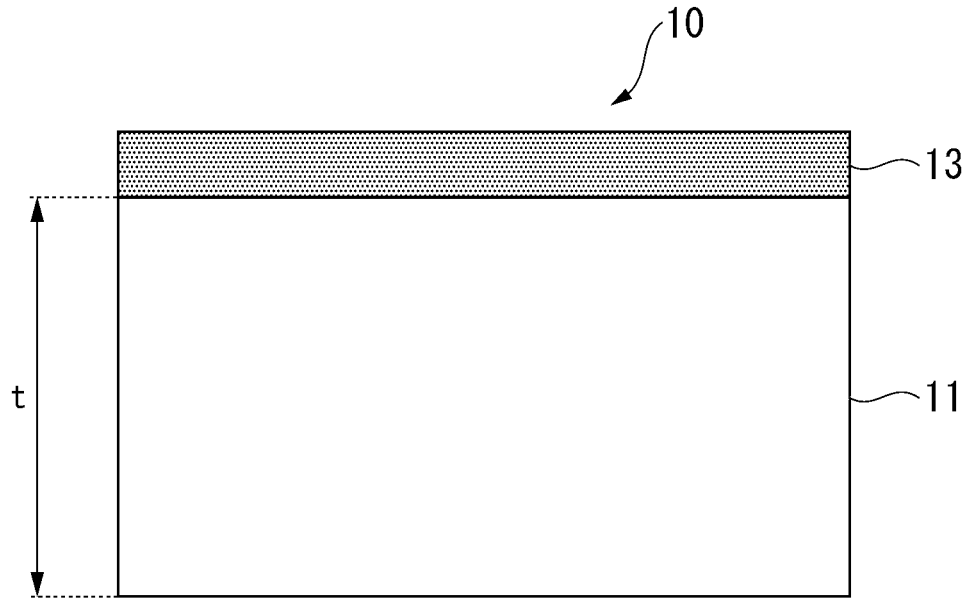
FIG. 1 is a view schematically showing a structure of a non-oriented electrical steel sheet according to an embodiment of the present invention.

Hereinafter, a preferred embodiment of the present invention will be described in detail with reference to drawings. In the present specification and the drawings, constitutional elements having substantially the same functional constitution will be given the same reference symbol and a duplicate description will not be provided.

(Regarding Non-Oriented Electrical Steel Sheet)

In non-oriented electrical steel sheets, as described in advance, in order to decrease iron loss, generally, alloying elements are added to steel, thereby increasing electrical resistance of the steel sheets and decreasing eddy-current loss. Here, in a case where it is considered that the alloying elements in the same amount (mass %) are added, Si easily increases the electrical resistance and is thus an effective element for decreasing iron loss. However, as a result of the present inventors' studies, it has been clarified that the cold rollability of non-oriented electrical steel sheets is significantly degraded, in a case where the Si content exceeds 4.0 mass %.

In addition, similar to Si, Al is also an alloying element that exhibits an effect of increasing the electrical resistance. However, as a result of the present inventors' studies, it has been clarified that Al also, similar to Si, degrades the cold rollability. In addition, when the Al content increases, there is a tendency that hysteresis loss is deteriorated and the magnetic properties are degraded. Therefore, it is difficult to add a large amount of Al to the non-oriented electrical steel sheet as an alloying element. In non-oriented electrical steel sheets, in order to suppress the degradation of the magnetic properties due to the deterioration of hysteresis loss, it is preferably that the Al content is set to be small.

The present inventors carried out intensive studies in order to find a method that improves the cold rollability while suppressing the degradation of the magnetic properties. As a result, it has been found that it is possible to improve the cold rollability and the magnetic properties, when the Al content is set to be equal to or less than a predetermined value, and Mn having a small adverse influence on the cold rollability is added together with Si.

In addition, in order to further improve the cold rollability, it is necessary to decrease the amounts of P, Sn, and Sb which are likely to cause the degradation of the cold rollability. However, the present inventors also found that a decrease in the amounts of Sn and Sb has a possibility of accelerating nitriding during final annealing and degrading the magnetic properties. As a result of additional studies, the present inventors found that it is possible to suppress the degradation of the magnetic properties even in a case where the amounts of Sn and Sb are decreased in order to further improve the cold rollability, when a surface layer portion of a steel sheet is appropriately oxidized during final annealing and nitriding is suppressed.

Hereinafter, a non-oriented electrical steel sheet according to an embodiment of the present invention (the non-oriented electrical steel sheet according to the present embodiment) and a method for manufacturing the same will be described in detail with reference to FIG. 1 and FIG. 2.

Figure 2:
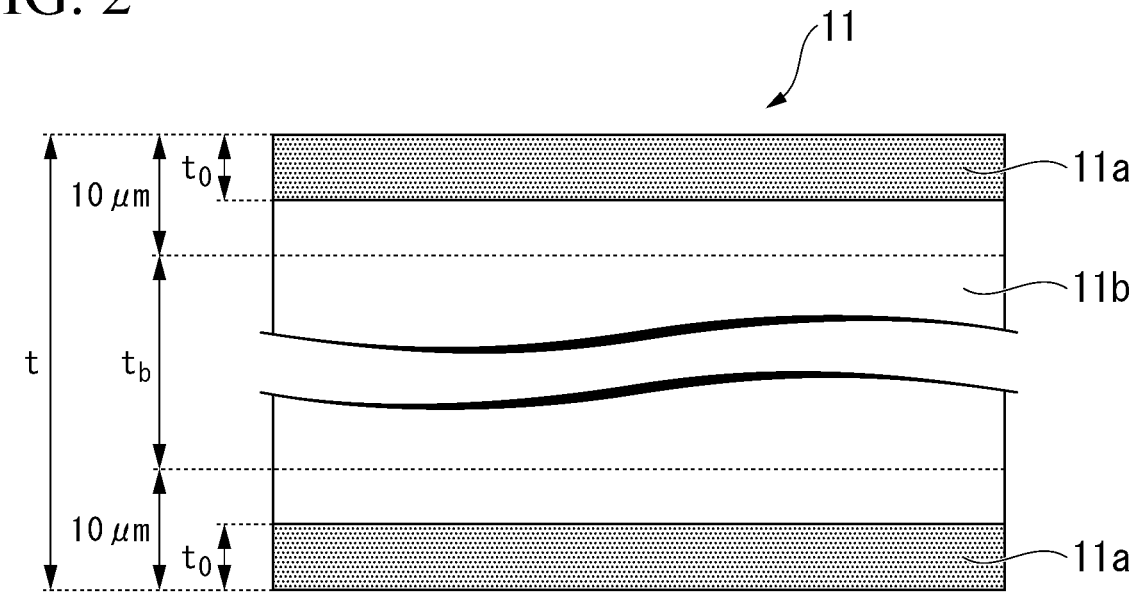
FIG. 2 is a view schematically showing a structure of a base of the non-oriented electrical steel sheet according to the same embodiment.

FIG. 1 is a view schematically showing the structure of the non-oriented electrical steel sheet according to the embodiment of the present invention, and FIG. 2 is a view schematically showing the structure of a base of the non-oriented electrical steel sheet according to the embodiment of the present invention.

A non-oriented electrical steel sheet 10 according to the present embodiment has a base 11 having a predetermined chemical composition, as schematically shown in FIG. 1. The non-oriented electrical steel sheet according to the present embodiment may consist of the base 11 alone, but preferably further has an insulating coating 13 on a surface of the base 11.

Hereinafter, first, the base 11 in the non-oriented electrical steel sheet 10 according to the present embodiment will be described in detail.

<Regarding Chemical Composition of Base>

The base 11 in the non-oriented electrical steel sheet 10 according to the present embodiment contains, as the chemical composition, by mass %, C: more than 0% and 0.0050% or less, Si: 3.0% to 4.0%, Mn: 1.0% to 3.3%, P: more than 0% and less than 0.030%, S: more than 0% and 0.0050% or less, sol. Al: more than 0% and 0.0040% or less, N: more than 0% and 0.0040% or less, O: 0.0110% to 0.0350%, Sn: 0% to 0.050%, Sb: 0% to 0.050%, Ti: more than 0% and 0.0050% or less, and a remainder consisting of Fe and impurities, and satisfies Sn+Sb: 0.050% or less and Si−0.5×Mn>2.0%.

Hereinafter, the reasons for regulating the chemical composition of the base 11 according to the present embodiment as described above will be described in detail. Hereinafter, unless otherwise noted, "%" regarding the chemical composition indicates "mass %".

[C: More than 0% and 0.0050% or Less]

Carbon (C) is an element that is inevitably contained and an element causing a deterioration in iron loss (an increase in iron loss). In a case where the C content exceeds 0.0050%, the deterioration in iron loss occurs in the non-oriented electrical steel sheet, and it is not possible to obtain favorable magnetic properties. Therefore, in the non-oriented electrical steel sheet according to the present embodiment, the C content is set to 0.0050% or less. The C content is preferably 0.0040% or less and more preferably 0.0030% or less. The smaller the C content is, the more preferable. However, C is an element that is inevitably contained, and the lower limit is set to more than 0%. In addition, when it attempts to decrease the C content to be less than 0.0005%, the cost is significantly increased. Therefore, the C content may be set to 0.0005% or more.

[Si: 3.0% to 4.0%]

Silicon (Si) is an element that increases the electrical resistance of steel, thereby decreasing eddy-current loss and improving high-frequency iron loss. In addition, Si has a great capability of solid solution strengthening and is thus an effective element for the high-strengthening of the non-oriented electrical steel sheet. In the non-oriented electrical steel sheet, the high-strengthening is required from the viewpoint of suppression of deformation or suppression of fatigue fracture during the high-speed rotation of motors. In order to make the above-described effect sufficiently exhibited, it is necessary that the Si content is set to 3.0% or more. The Si content is preferably 3.1% or more and more preferably 3.2% or more.

Meanwhile, in a case where the Si content exceeds 4.0%, the workability is significantly deteriorated, and it becomes difficult to carry out cold rolling or the steel sheet breaks during cold rolling (that is, the cold rollability is degraded). Therefore, the Si content is set to 4.0% or less. The Si content is preferably 3.9% or less and more preferably 3.8% or less.

[Mn: 1.0% to 3.3%]

Manganese (Mn) is an element that increases the electrical resistance, thereby decreasing eddy-current loss and improving high-frequency iron loss. In addition, Mn is an element that has a smaller capability of the solid solution strengthening of a non-oriented electrical steel sheet than Si, but does not deteriorate the workability, and is capable of contributing to the high-strengthening. In order to make the above-described effect sufficiently exhibited, it is necessary that the Mn content is set to 1.0% or more. The Mn content is preferably 1.2% or more, more preferably 1.4% or more.

Meanwhile, in a case where the Mn content exceeds 3.3%, the density of magnetic flux is significantly decreased. Therefore, the Mn content is set to 3.3% or less. The Mn content is preferably 3.0% or less, more preferably 2.8% or less.

[P: More than 0% and Less than 0.030%]

Phosphorus (P) is an element that significantly deteriorates the workability and makes cold rolling difficult, in high alloy steel where the Si content and the Mn content are large. Therefore, the P content is set to less than 0.030%. The P content is preferably 0.020% or less and more preferably 0.010% or less.

The smaller the P content is, the more preferable. However, P is an element that is inevitably contained, and the lower limit is set to more than 0%. When the P content is set to less than 0.001%, a significant increase in cost is caused. Therefore, the lower limit is preferably set to 0.001% or more and more preferably 0.002% or more.

[S: More than 0% and 0.0050% or Less]

Sulfur (S) is an element that increases iron loss by forming fine precipitates of MnS and deteriorates the magnetic properties of the non-oriented electrical steel sheet. Therefore, it is necessary that the S content is set to 0.0050% or less. The S content is preferably 0.0040% or less and more preferably 0.0035% or less.

The smaller the S content is, the more preferable. However, S is an element that is inevitably contained, and the lower limit is set to more than 0%. In addition, when it attempts to decrease the S content to be less than 0.0001%, the cost is significantly increased. Therefore, the S content is set to 0.0001% or more.

[Sol. Al: More than 0% and 0.0040% or Less]

Aluminum (Al) is an element that increases the electrical resistance of the non-oriented electrical steel sheet, thereby decreasing eddy-current loss and improving high-frequency iron loss, when forming a solid solution in steel. However, in the non-oriented electrical steel sheet according to the present embodiment, rather than Al, Mn which is an element that increases the electrical resistance without deteriorating the workability is more actively contained. Therefore, it is not necessary to actively contain Al. In addition, when the amount of sol. Al (acid-soluble Al) exceeds 0.0040%, a fine nitride is precipitated in steel, grain growth during annealing hot-rolled sheet or final annealing is impaired, and the magnetic properties are deteriorated. Therefore, the amount of sol. Al is set to 0.0040% or less. The amount of sol. Al is preferably 0.0030% or less and more preferably 0.0020% or less.

Meanwhile, Al is an element that is inevitably contained, and the lower limit is set to more than 0%. When it attempts to decrease the amount of sol. Al to be less than 0.0001%, the cost is significantly increased. Therefore, the amount of sol. Al is preferably 0.0001% or more.

[N: More than 0% and 0.0040% or Less]

Nitrogen (N) is an element that increases iron loss by forming a fine nitride in steel and deteriorates the magnetic properties of the non-oriented electrical steel sheet. Therefore, it is necessary that the N content is set to 0.0040% or less. The N content is preferably 0.0030% or less and more preferably 0.0020% or less.

Meanwhile, N is an element that is inevitably contained, and the lower limit is set to more than 0%. In addition, the smaller the N content is, the more preferable. When it attempts to decrease the N content to be less than 0.0001%, the cost is significantly increased. Therefore, the N content is preferably 0.0001% or more. The N content is more preferably 0.0003% or more.

[O: 0.0110% to 0.0350%]

When the Sn content and the Sb content are decreased to ranges described below, nitriding on steel sheet surfaces during final annealing is accelerated. Oxygen (O) is an element that is introduced to steel during final annealing in order to prevent nitriding during final annealing. In order to prevent nitriding during final annealing, it is necessary to introduce oxygen into steel so that the O content becomes 0.0110% or more. The O content is preferably 0.0115% or more and more preferably 0.0120% or more.

On the other hand, in a case where the O content exceeds 0.0350%, an oxidation layer in a steel sheet surface layer portion that is formed by the introduction of oxygen becomes thick, and the magnetic properties are deteriorated, which is not preferable. Therefore, the O content is set to 0.0350% or less. The O content is preferably 0.0330% or less and more preferably 0.0300% or less.

Generally, when the steel sheet is nitrided during final annealing, iron loss is increased. On the other hand, when the steel sheet surface is oxidized, it is possible to suppress nitriding; however, conversely, the magnetic properties are degraded due to generated oxide. Therefore, in the related art, the steel sheet surface has not been oxidized. In contrast, the present inventors newly found that nitriding is suppressed and the degradation of the magnetic properties by oxide is also suppressed to the minimum level, when the overall amount of oxygen is controlled to become 0.0110% to 0.0350% in a specific component system.

The O content of 0.0110% or more and 0.0350% or less as described above refers to the average amount in the entire base 11 in a sheet thickness direction as described below in detail. In the non-oriented electrical steel sheet according to the present embodiment, oxygen (O) in the base 11 is introduced to steel mainly during final annealing. Therefore, majority of the introduced oxygen is present in the surface layer portion of the base 11 as described in detail below, and the distribution of oxygen along the sheet thickness direction is not uniform. The amounts of oxygen (the O content) in portions other than the surface layer portion of the base 11 will be described below again.

[Sn: 0% to 0.050%]

[Sb: 0% to 0.050%]

Sn and Sb do not necessarily need to be contained, and the lower limits are 0%.

Tin (Sn) and antimony (Sb) are useful elements that ensure a low iron loss by segregating on the surface of the steel sheet and suppressing nitriding during annealing. Therefore, in the non-oriented electrical steel sheet according to the present embodiment, in order to obtain the above-described effect, it is preferable that at least any one of Sn and Sb is contained in the base 11.

Specifically, the Sn content is preferably 0.005% or more and more preferably 0.010% or more. In addition, the Sb content is preferably 0.005% or more and more preferably 0.010% or more.

On the other hand, in a case where the amounts of Sn and Sb exceed 0.050% respectively, the ductility of the base degrades and cold rolling becomes difficult. Therefore, even in a case where Sn and Sb are contained, the amounts of Sn and Sb are preferably set to 0.050% or less respectively. The Sn content is more preferably 0.040% or less and still more preferably 0.030% or less. In addition, the Sb content is more preferably 0.040% or less and still more preferably 0.030% or less.

[Sn+Sb: 0.050% or Less]

As described above, Sn and Sb are the elements that cause the degradation of the cold rollability when contained a lot in the base 11. Particularly, when the total amount of Sn and Sb exceeds 0.050%, the cold rollability is significantly degraded. Therefore, the total amount of Sn and Sb is set to 0.050% or less. The total amount of Sn and Sb is preferably 0.040% or less and more preferably 0.030% or less.

[Ti: More than 0% and 0.0050% or Less]

Titanium (Ti) is inevitably contained in the raw material of Mn or Si. Ti is an element that bonds with C, N, O, or the like in the base, forms a fine precipitate such as TiN, TiC, or a Ti oxide, impairs the growth of grains during annealing, and deteriorates the magnetic properties. Therefore, the Ti content is set to 0.0050% or less and is preferably 0.0040% or less and more preferably 0.0030% or less.

On the other hand, Ti is an element that is inevitably contained, and the lower limit is set to more than 0%. When it attempts to set the Ti content to less than 0.0003%, significant increase in cost is caused, and thus the Ti content is preferably set to 0.0003% or more and more preferably 0.0005% or more.

The non-oriented electrical steel sheet according to the present embodiment basically includes the above-described elements with the remainder consisting of Fe and impurities. However, the non-oriented electrical steel sheet according to the present embodiment may contain, in addition to the above-described elements, elements such as nickel (Ni), chromium (Cr), copper (Cu), and molybdenum (Mo). When the above-described elements are contained in an amount of 0.50% or less respectively, the effect of the non-oriented electrical steel sheet according to the present embodiment is not impaired. In addition, in order to accelerate grain growth during final annealing of the non-oriented electrical steel sheet, the non-oriented electrical steel sheet may contain calcium (Ca), magnesium (Mg), lanthanum (La), cerium (Ce), praseodymium (Pr), and neodymium (Nd) respectively in a range of 100 ppm (0.0100%) or less.

In addition, the non-oriented electrical steel sheet may contain, in addition to the above-described elements, elements such as lead (Pb), bismuth (Bi), vanadium (V), arsenic (As), and boron (B). When the above-described elements are contained respectively in a range of 0.0001% to 0.0050%, the effect of the non-oriented electrical steel sheet according to the present embodiment is not impaired.

[Si−0.5×Mn: 2.0% or More]

In the non-oriented electrical steel sheet according to the present embodiment, once the amounts of the respective elements are controlled as described above, it is necessary to control the Si content and the Mn content so as to satisfy a predetermined relationship.

In addition, Si is an element for accelerating formation of ferrite phase (that is, ferrite former element), and on the other hand, Mn that is an alloying element is an element for accelerating formation of austenite phase (that is, austenite former element). Therefore, the metallographic structure of the non-oriented electrical steel sheet changes depending on the respective amounts of Si and Mn, the non-oriented electrical steel sheet becomes the alloy system having a transformation point or becomes the alloy system having no transformation point. In the non-oriented electrical steel sheet according to the present embodiment, it is necessary to appropriately increase the average grain diameter in the base 11, and the manufacturing of the non-oriented electrical steel sheet as the alloy system having no transformation point is an effective method for increasing grain diameters. Therefore, the respective amounts of Si and Mn preferably satisfy a predetermined relationship so that the non-oriented electrical steel sheet becomes the alloy system having no transformation point.

According to the present inventors' studies, the capability for accelerating the formation of austenite phase (in other words, an effect of negating the capability for accelerating the formation of ferrite phase) of Mn is considered to be approximately 0.5 times the capability for accelerating the formation of ferrite phase of Si. Therefore, the equivalent amount of the capability for accelerating the formation of ferrite phase in the present embodiment can be expressed as "Si−0.5×Mn" based on the Si content.

In a case where the value of Si−0.5×Mn is less than 2.0%, the non-oriented electrical steel sheet becomes the alloy system having a transformation point. As a result, during a high-temperature treatment in the manufacturing process, the metallographic structure of the steel sheet does not become a ferrite single phase, and there is a concern that the magnetic properties of the non-oriented electrical steel sheet may be degraded. Therefore, it is necessary that the value of Si−0.5×Mn is set to 2.0% or more and is preferably 2.1% or more.

Meanwhile, the upper limit value of Si−0.5×Mn is not particularly regulated, but the value of Si−0.5×Mn is not exceeding 3.5% due to the ranges of the Si content and the Mn content in the non-oriented electrical steel sheet according to the present embodiment. Therefore, the upper limit value of Si−0.5×Mn becomes substantially 3.5%.

Hitherto, the chemical composition of the base in the non-oriented electrical steel sheet according to the present embodiment has been described in detail.

In a case where the chemical composition of the base in the non-oriented electrical steel sheet is measured afterwards, it is possible to use a variety of well-known measurement methods. For example, spark discharge emission spectrometry method or ICP light emission analysis method may be used, in a case where C and S are accurately measured, combustion-infrared absorption method may be used, and in a case where O and N are accurately measured, inert gas melting-infrared absorption method/thermal conductivity method, or the like may be appropriately used.

<Regarding Distribution Status of Oxygen in Base>

Next, with reference to FIG. 2, the distribution status of oxygen in the base 11 of the non-oriented electrical steel sheet 10 according to the present embodiment will be described in detail.

As simply described in advance, when the non-oriented electrical steel sheet 10 according to the present embodiment is manufactured, a treatment that appropriately oxidizes the surface layer portion of the steel sheet is carried out during final annealing. The oxidation treatment during final annealing is carried out by controlling the dew point of the annealing atmosphere, and thus oxygen atoms intrude from the surface of the base 11 toward the inside of the base 11. As a result, in the surface layer portion of the base 11 of the non-oriented electrical steel sheet 10 according to the present embodiment, as schematically shown in FIG. 2, surface layer oxidation portions 11*a* in a state in which oxygen is concentrated are formed, and a base material portion 11*b* that is a portion other than the surface layer oxidation portions 11*a* and the surface layer oxidation portions 11*a* differ in the amount of oxygen (the O content).

Here, as a result of studies carried out by the present inventors under a variety of final annealing conditions, a thickness $t_o$ of the surface layer oxidation portion 11*a* shown in FIG. 2 was at largest approximately several micrometers. In addition, FIG. 2 shows that an end portion of the surface layer oxidation portion 11*a* on the base material portion 11*b* side is flat for the convenience of drawing, but the actual boundary surface between the surface layer oxidation portion 11*a* and the base material portion 11*b* is not flat in many cases. Therefore, when the O content in portions other than the surface layer oxidation portions 11*a* in the base 11 is taken into account, in the present embodiment, in consideration of the non flatness of the boundary surface between the surface layer oxidation portion 11*a* and the base material portion 11*b*, a range from a front surface and a rear surface of the base 11 to a position of 10 μm in a depth direction are excluded, and attention is paid to the O content in the remaining sheet thickness central portion (a portion represented by a sheet thickness $t_b$ in FIG. 2).

In the base 11 in the non-oriented electrical steel sheet 10 according to the present embodiment, the O content in the sheet thickness central portion excluding the surface layer portion which is the range from the front surface and the rear surface of the steel sheet (the base 11) to the position of 10 μm in the depth direction is less than 0.0100%. In a case where the O content in the sheet thickness central portion is 0.0100% or more, oxide in steel is increased, and the magnetic properties are deteriorated, which is not preferable. The O content in the sheet thickness central portion is preferably 0.0080% or less and may be 0%.

The O content in the base 11 of 0.0110% to 0.0350% mentioned in advance refers to the average O content in the entire base 11 in the sheet thickness direction and is different from the O content in the sheet thickness central portion.

The O content in the sheet thickness central portion excluding the range from the front surface and the rear surface of the steel sheet (the base 11) to the position of 10 μm in the depth direction as described above can also be said as the O content in a steel ingot which serves as a basis of the base 11.

The O content in the sheet thickness central portion can be measured using, for example, a variety of well-known measurement methods such as inert gas melting-infrared absorption method/thermal conductivity method after the range from the front surface and the rear surface of the steel sheet (the base 11) to the position of 10 in the depth direction are removed using a well-known method such as chemical polishing.

In addition, when the O content in the sheet thickness central portion and the average O content (average oxygen amount) in the entire steel sheet in the sheet thickness direction are specified, it is possible to calculate the O content in the range from the front surface and the rear surface of the steel sheet (the base 11) to the position of 10 μm in the depth direction (in other words, the O content in the surface layer oxidation portions 11*a*). In more detail, the O content in the surface oxidation portions 11*a* can be calculated using Expression (1) below with reference to FIG. 2.

$$O_1=(20/t)\times O_{10\ \mu m}+[(t-20)/t]\times O_b \quad (1)$$

Here, the meanings of the respective signs in Expression (1) are as described below.

$O_t$ (mass %): The average O content in the entire steel sheet in the sheet thickness direction $O_{10\ \mu m}$ (mass %): The O content in the range from the front surface and the rear surface of the steel sheet (the base) to the position of 10 μm in the depth direction $O_b$ (mass %): The O content in the portion excluding the range from the front surface and the rear surface of the steel sheet (the base) to the position of 10 min in the depth direction t (μm): The thickness of the base Hitherto, the distribution status of oxygen in the base 11 according to the present embodiment has been described in detail with reference to FIG. 2.

<Regarding Sheet Thickness of Base>

The sheet thickness (the thickness tin FIG. 1 and FIG. 2) of the base 11 in the non-oriented electrical steel sheet 10 according to the present embodiment is preferably set to 0.40 mm or less in order to decrease high-frequency iron loss by decreasing eddy-current loss. Meanwhile, in a case where the sheet thickness t of the base 11 is less than 0.10 mm, the sheet thickness is thin, and thus there is a possibility that the threading of an annealing line may become difficult. Therefore, the sheet thickness t of the base 11 in the non-oriented electrical steel sheet 10 is preferably set to 0.10 mm or more and 0.40 mm or less. The sheet thickness t of the base 11 in the non-oriented electrical steel sheet 10 is more preferably 0.15 mm or more and 0.35 mm or less.

Hitherto, the base 11 in the non-oriented electrical steel sheet 10 according to the present embodiment has been described in detail.

<Regarding Insulating Coating>

Subsequently, an insulating coating 13 that the non-oriented electrical steel sheet 10 according to the present embodiment preferably has will be simply described.

In order to improve the magnetic properties of the non-oriented electrical steel sheet, although it is important to decrease iron loss, the iron loss is configured of eddy-current loss and hysteresis loss. When the insulating coating 13 is provided on a surface of the base 11, it becomes possible to suppress electrical conduction between the electrical steel sheets laminated as an iron core and decrease the eddy-current loss of the iron core, and thus it becomes possible to further improve the practical magnetic properties of the non-oriented electrical steel sheet 10.

Here, the insulating coating 13 that the non-oriented electrical steel sheet 10 according to the present embodiment includes is not particularly limited as long as the insulating coating can be used as an insulating coating for non-oriented electrical steel sheets, and it is possible to use well-known insulating coatings. As the above-described insulating coating, for example, composite insulating coatings mainly composed of an inorganic substance as main component and further including an organic substance can be mentioned. Here, the composite insulating coating refers to an insulating coating which includes at least any inorganic substance, for example, a chromic acid metal salt, a phosphoric acid metal salt, a colloidal silica, a Zr compound, a Ti compound, or the like as main component and in which fine particles of an organic resin are dispersed. Particularly, from the viewpoint of decreasing in environmental loads during manufacturing, which has been increasingly required in recent years, insulating coatings in which a phosphoric acid metal salt, a Zr or Ti coupling agent, or a carbonate or ammonium salt thereof is used as the starting material are preferably used.

The attachment amount of the insulating coating 13 as described above is not particularly limited, but is preferably set to, for example, 0.1 $g/m^2$ or more and 2.0 $g/m^2$ or less per one side of surface and more preferably set to 0.3 $g/m^2$ or more and 1.5 $g/m^2$ or less per one side of surface. When the insulating coating 13 is formed so as to obtain the above-described attachment amount, it becomes possible to hold excellent uniformity. In a case where the attachment amount of the insulating coating 13 is measured afterwards, it is possible to use a variety of well-known measurement methods. The attachment amount of the insulating coating 13 can be calculated from, for example, a difference in mass before and after the removal of the insulating coating 13 by immersing the non-oriented electrical steel sheet 10 with the insulating coating 13 formed in a thermal alkali solution to remove only the insulating coating 13.

<Regarding Method for Measuring Magnetic Properties of Non-Oriented Electrical Steel Sheet>

The non-oriented electrical steel sheet 10 according to the present embodiment has the above-described structure and thus exhibits excellent magnetic properties. Here, a variety of magnetic properties exhibited by the non-oriented electrical steel sheet 10 according to the present embodiment can be measured on the basis of the Epstein method regulated in JIS C2550 or a single sheet magnetic properties measurement method (single sheet tester: SST) regulated in JIS C2556.

Hitherto, the non-oriented electrical steel sheet 10 according to the present embodiment has been described in detail with reference to FIG. 1 and FIG. 2.

(Regarding Method for Manufacturing Non-Oriented Electrical Steel Sheet)

Subsequently, a preferred method for manufacturing the non-oriented electrical steel sheet 10 according to the present embodiment as described above will be simply described with reference to FIG. 3.

Figure 3:
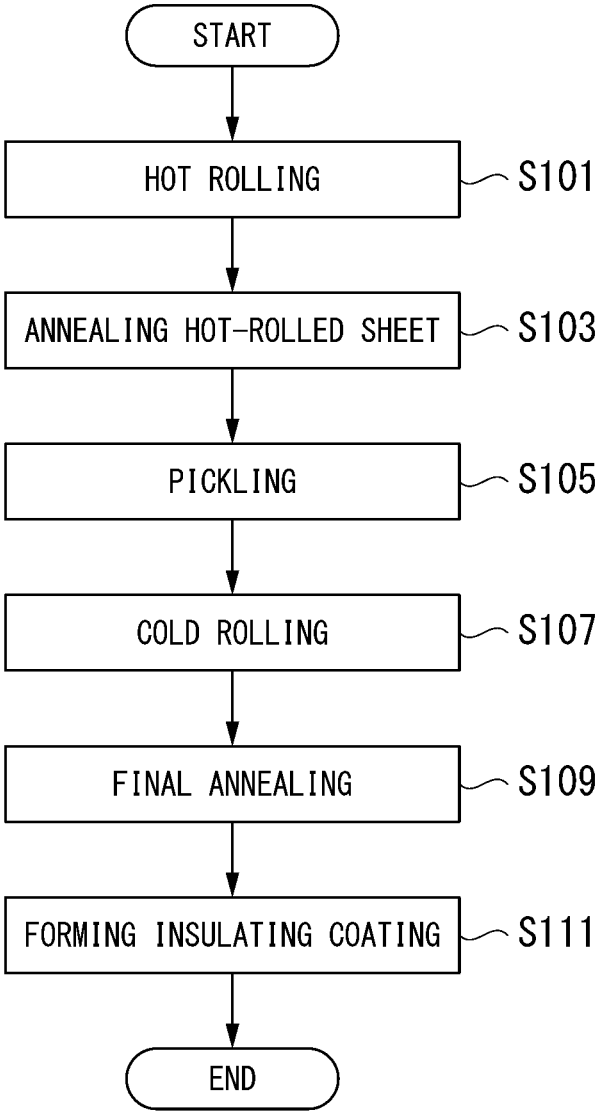
FIG. 3 is a view showing an example of a flow of a method for manufacturing the non-oriented electrical steel sheet according to the same embodiment.

FIG. 3 is a flow chart showing an example of the flow of the method for manufacturing the non-oriented electrical steel sheet according to the present embodiment.

In the method for manufacturing the non-oriented electrical steel sheet 10 according to the present embodiment, hot rolling, annealing of hot-rolled sheet, pickling, cold rolling, and final annealing are sequentially carried out on a steel ingot having a predetermined chemical composition as described above. In addition, in a case where the insulating coating 13 is formed on the surface of base 11, the insulating coating is formed after the final annealing. Hereinafter, individual steps carried out in the method for manufacturing the non-oriented electrical steel sheet 10 according to the present embodiment will be described in detail.

<Hot Rolling Step>

In the method for manufacturing the non-oriented electrical steel sheet according to the present embodiment, first, a steel ingot (slab) in which by mass %, C: more than 0% and 0.0050% or less, Si: 3.0% to 4.0%, Mn: 1.0% to 3.3%, P: more than 0% and less than 0.030%, S: more than 0% and 0.0050% or less, sol. Al: more than 0% and 0.0040% or less, N: more than 0% and 0.0040% or less, O: less than 0.0100%, Sn: 0% to 0.050%, Sb: 0% to 0.050%, Ti: more than 0% and 0.0050% or less, and a remainder consisting of Fe and impurities and Sn+Sb is 0.050% or less, and Si−0.5×Mn is 2.0% or more is heated, and the heated steel ingot is hot-rolled, thereby obtaining a hot-rolled steel sheet (Step S101). Although the heating temperature of the steel ingot that is subjected to hot rolling is not particularly regulated, for example, is preferably set to 1,050° C. to 1,300° C. The heating temperature of the steel ingot is more preferably 1,050° C. to 1,250° C.

In addition, although the sheet thickness of the hot-rolled steel sheet after the hot rolling is not particularly regulated, for example, is preferably set to approximately 1.6 mm to 3.5 mm in consideration of the final sheet thickness of the base. The hot rolling step is preferably ended while the temperature of the steel sheet is in a range of 700° C. to 1,000° C. The hot rolling-end temperature is more preferably 750° C. to 950° C.

<Hot-Rolled Sheet Annealing Step>

After the hot rolling, annealing of hot-rolled sheet (annealing on the hot-rolled steel sheet) is carried out (Step S103). In a case of continuous annealing, with respect to the hot-rolled steel sheet, for example, annealing at 750° C. to 1,200° C. including soaking for 10 seconds to 10 minutes is carried out. In addition, in a case of box annealing, with respect to the hot-rolled steel sheet, for example, annealing at 650° C. to 950° C. including soaking for 30 minutes to 24 hours is carried out.

<Pickling Step>

After the annealing hot-rolled sheet step, pickling is carried out (Step S105). Therefore, a scale layer including an oxide as main component which is formed on the surface of the steel sheet during annealing the hot-rolled sheet is removed. In a case where hot-rolled sheet is treated by box annealing, the pickling step is preferably carried out before annealing the hot-rolled sheet from the viewpoint of descaling property.

<Cold Rolling Step>

After the pickling step (also after the annealing hot-rolled sheet step in a case where annealing the hot-rolled sheet is carried out by box annealing), on the hot-rolled steel sheet, cold rolling is carried out (Step S107). In the cold rolling, the pickled sheet from which the scale has been removed is rolled at a rolling reduction that the final sheet thickness of the base becomes 0.10 mm to 0.40 mm.

<Final Annealing Step>

After the cold rolling step, with respect to the cold-rolled steel sheet obtained by the cold rolling step, final annealing is carried out (Step S109). In the final annealing step, final annealing conditions are controlled so that the average O content in the entire cold-rolled steel sheet in the sheet thickness direction becomes 0.0110 mass % to 0.0350 mass % after the final annealing. Therefore, the final annealing step includes a temperature rising process, a soaking process, and a cooling process, and, in the final annealing step of the method for manufacturing a non-oriented electrical steel sheet according to the present embodiment, it is necessary to control the respective processes.

Specifically, in the temperature rising process, the average temperature rising rate is preferably set to 1° C./second to 2,000° C./second. In addition, the atmosphere in the furnace during the temperature rising is preferably set to a mixed atmosphere of $H_2$ and $N_2$ (that is, $H_2$+$N_2$=100 volume %) in which the fraction of $H_2$ is 10 volume % to 100 volume %, and the dew point of the atmosphere is preferably set to −10° C. to 40° C. The average temperature rising rate is more preferably 5° C./second to 1,500° C./second, and the fraction of $H_2$ in the atmosphere is more preferably 15 volume % to 90 volume %, and the dew point of the atmosphere is more preferably −5° C. to 35° C. and still more preferably 0° C. to 30° C.

In the method for manufacturing the non-oriented electrical steel sheet according to the present embodiment, the temperature rising process in the final annealing is rapid heating. When the heating in the temperature rising process is carried out rapidly, a recrystallization texture advantageous to the magnetic properties is formed in the base 11. In a case where the temperature rising process in the final annealing is rapid heating, in the method for manufacturing the non-oriented electrical steel sheet according to the present embodiment, the final annealing is preferably carried out by continuous annealing. The above-described average heating speed can be realized using direct heating or indirect heating in which a radiant tube is used or using other well-known heating method such as energization heating or induction heating in a case of heating by gas combustion.

In the soaking process after the temperature rising process, it is preferable that the soaking temperature is set to 700° C. to 1,100° C., the soaking time is set to 1 second to 300 seconds, the atmosphere is set to a mixed atmosphere of $H_2$ and $N_2$ (that is, $H_2$+$N_2$=100 volume %) in which the fraction of $H_2$ is 10 volume % to 100 volume %, and the dew point of the atmosphere is set to −10° C. to 40° C. The soaking temperature is more preferably 750° C. to 1,050° C., and the fraction of $H_2$ in the atmosphere is more preferably 15 volume % to 90 volume %, and the dew point of the atmosphere is more preferably −10° C. to 30° C. and still more preferably −5° C. to 20° C.

In the cooling process after the soaking process, the cold-rolled steel sheet is preferably cooled to 200° C. or lower at an average cooling rate of 1° C./second to 50° C./second. The average cooling rate is more preferably 5° C./second to 30° C./second.

According to the manufacturing method including the respective processes described above, it is possible to manufacture the non-oriented electrical steel sheet 10 according to the present embodiment.

<Forming Insulating Coating Step>

After the final annealing, forming insulating coating step is carried out as necessary (Step S111). Here, the forming insulating coating step is not particularly limited, and coating and drying a treatment liquid may be carried out by a well-known method using a well-known insulating coating treatment liquid as described above.

On the surface of the base 11 on which the insulating coating is to be formed, an arbitrary pretreatment such as degreasing using an alkali or the like or a pickling treatment using hydrochloric acid, sulfuric acid, phosphoric acid, or the like may be carried out before coating the treatment liquid. Coating and drying the treatment liquid may be carried out on the surface that has been subjected to the final annealing without carrying out the pretreatment.

Hitherto, the method for manufacturing the non-oriented electrical steel sheet according to the present embodiment has been described in detail with reference to FIG. 3.

EXAMPLES

Hereinafter, the non-oriented electrical steel sheet and the method for manufacturing a non-oriented electrical steel sheet according to the present invention will be specifically described while showing the examples. Examples described below are simply samples of the non-oriented electrical steel sheet and the method for manufacturing a non-oriented electrical steel sheet according to the present embodiment, and the non-oriented electrical steel sheet and the method for manufacturing a non-oriented electrical steel sheet according to the present invention is not limited to the following examples.

Experiment Example 1

Steel slabs containing a composition shown in Table 1 below with a remainder consisting of Fe and impurities were heated to 1,150° C. and then rolled to a thickness of 2.0 mm by hot rolling. Subsequently, the hot-rolled steel sheets were annealed at a soaking temperature of 1,000° C. for a soaking time of 40 seconds in an annealing furnace of continuous annealing-type and then cold-rolled, thereby producing cold-rolled steel sheets having thickness of 0.25 mm. With respect to these cold-rolled steel sheets, final annealing was carried out at a soaking temperature of 1,000° C. for a soaking time of 15 seconds. After that, furthermore, a solution including a phosphoric acid metal salt as main component and including an emulsion of an acrylic resin was applied and baked to both surfaces of the steel sheets to form composite insulating coatings, thereby manufacturing non-oriented electrical steel sheets.

During the final annealing, for all of test numbers, the atmospheres of the temperature rising process and the soaking process were controlled to become an atmosphere of 20 volume % of $H_2$ and 80 volume % of $N_2$. In addition, the dew points were −30° C. for Test Number 1, +5° C. for Test Number 2, +15° C. for Test Number 3, +45° C. for Test Number 4, +15° C. for Test Number 5, −15° C. for Test Number 6, and +45° C. for Test Number 7. In addition, the average temperature rising rate in the temperature rising process during the final annealing was set to 200° C./second, and the average cooling rate in the cooling process was set to 20° C./second. After the final annealing, the cold-rolled steel sheets were cooled to 200° C. or lower.

In Table 1, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are summarized in Table 1.

TABLE 1

| Test Number | Composition of steel slab (mass %) | | | | | | | | | | | | |
|---|---|---|---|---|---|---|---|---|---|---|---|---|---|
| | C | Si | Mn | P | S | sol. Al | N | O | Sn | Sb | Ti | Sn + Sb | Si − 0.5 × Mn |
| 1 | 0.0026 | 3.6 | 1.8 | 0.008 | 0.0020 | 0.0012 | 0.0015 | 0.0032 | 0.020 | Tr. | 0.0012 | 0.020 | 2.7 |
| 2 | | | | | | | | | | | | | |
| 3 | | | | | | | | | | | | | |
| 4 | | | | | | | | | | | | | |
| 5 | 0.0025 | 3.6 | 1.8 | 0.007 | 0.0020 | 0.0013 | 0.0014 | 0.0120 | 0.021 | Tr. | 0.0012 | 0.021 | 2.7 |
| 6 | 0.0023 | 3.4 | 2.6 | 0.008 | 0.0023 | 0.0010 | 0.0016 | 0.0035 | 0.025 | Tr. | 0.0011 | 0.025 | 2.1 |
| 7 | | | | | | | | | | | | | |

| Test Number | O content after final annealing (mass %) | | $W_{10/400}$ (W/kg) | $B_{50LC}$ (T) | Note |
|---|---|---|---|---|---|
| | After removal of 10 μm from front and rear surfaces | Total sheet thickness | | | |
| 1 | 0.0033 | 0.0039 | 11.8 | 1.65 | Comparative Example |
| 2 | 0.0034 | 0.0120 | 11.1 | 1.65 | Invention Example |
| 3 | 0.0032 | 0.0215 | 10.9 | 1.65 | Invention Example |
| 4 | 0.0032 | 0.0432 | 12.1 | 1.63 | Comparative Example |
| 5 | 0.0120 | 0.0220 | 12.0 | 1.63 | Comparative Example |
| 6 | 0.0035 | 0.0115 | 11.2 | 1.64 | Invention Example |
| 7 | 0.0035 | 0.0385 | 12.2 | 1.62 | Comparative Example |

As is clear from Table 1, Test Number 1 in which the O content after the final annealing was below the range of the present invention, Test Number 4 and Test Number 7 in which the O contents after the final annealing were above the range of the present invention, and Test Number 5 in which the O content in the sheet thickness central portion was above the range of the present invention were poor in the iron loss and/or the density of magnetic flux. On the other hand, Test Number 2, Test Number 3, and Test Number 6 in which the O contents in the steel sheets after the final annealing were in the range of the present invention were excellent in both the iron loss and the density of magnetic flux.

Experiment Example 2

Steel slabs containing a composition shown in Table 2 with a remainder consisting of Fe and impurities were heated to 1,150° C. and then rolled to a thickness of 2.0 mm by hot rolling. Subsequently, the hot-rolled steel sheets were annealed in an annealing furnace of continuous annealing-type under conditions in which the soaking temperature was 1,000° C. and the soaking time was 40 seconds and then cold-rolled, thereby obtaining cold-rolled steel sheets having thickness of 0.25 mm. After that, with respect to these cold-rolled steel sheets, final annealing was carried out under conditions in which the soaking temperature was 1,000° C. and a soaking time was 15 seconds. After that, furthermore, a solution including a phosphoric acid metal salt as main component and including an emulsion of an acrylic resin was applied and baked to both surfaces of the steel sheets to form composite insulating coatings, thereby manufacturing non-oriented electrical steel sheets.

During the final annealing, for all of test numbers, the atmospheric conditions selected during the temperature rising process and the soaking process were controlled to become an atmosphere of 20 volume % of $H_2$ and 80 volume % of $N_2$. The dew point was +10° C. In addition, the average temperature rising rate in the temperature rising process during the final annealing was set to 30° C./second, and the average cooling rate in the cooling process was set to 20° C./second. After the final annealing, the cold-rolled steel sheets were cooled to 200° C. or lower.

In Table 2, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are also summarized in Table 2.

TABLE 2

| Test Number | Composition of steel slab (mass %) | | | | | | | | | | | | |
|---|---|---|---|---|---|---|---|---|---|---|---|---|---|
| | C | Si | Mn | P | S | sol. Al | N | O | Sn | Sb | Ti | Sn + Sb | Si − 0.5 × Mn |
| 8 | 0.0026 | 4.2 | 2.6 | 0.008 | 0.0018 | 0.0010 | 0.0015 | 0.0029 | Tr. | Tr. | 0.0014 | Tr. | 2.9 |
| 9 | 0.0026 | 3.8 | 2.6 | 0.008 | 0.0018 | 0.0011 | 0.0015 | 0.0028 | Tr. | Tr. | 0.0015 | Tr. | 2.5 |
| 10 | 0.0027 | 3.8 | 2.6 | 0.008 | 0.0019 | 0.0012 | 0.0018 | 0.0028 | 0.023 | Tr. | 0.0015 | 0.023 | 2.5 |
| 11 | 0.0026 | 3.8 | 2.6 | 0.008 | 0.0017 | 0.0011 | 0.0016 | 0.0029 | 0.082 | Tr. | 0.0014 | 0.082 | 2.5 |

TABLE 2-continued

| | | | | | | | | | | | | | |
|---|---|---|---|---|---|---|---|---|---|---|---|---|---|
| 12 | 0.0027 | 3.8 | 2.6 | 0.008 | 0.0019 | 0.0013 | 0.0018 | 0.0025 | 0.045 | 0.0043 | 0.0014 | 0.088 | 2.5 |
| 13 | 0.0027 | 3.8 | 2.6 | 0.008 | 0.0018 | 0.0009 | 0.0016 | 0.0028 | 0.013 | 0.0080 | 0.0015 | 0.021 | 2.5 |
| 14 | 0.0026 | 3.8 | 2.6 | 0.055 | 0.0017 | 0.0012 | 0.0015 | 0.0025 | 0.013 | Tr. | 0.0014 | 0.013 | 2.5 |
| 15 | 0.0025 | 3.8 | 2.6 | 0.008 | 0.0018 | 0.0056 | 0.0018 | 0.0028 | 0.010 | Tr. | 0.0015 | 0.010 | 2.5 |
| 16 | 0.0026 | 3.8 | 2.6 | 0.008 | 0.0008 | 0.0011 | 0.0018 | 0.0025 | 0.013 | Tr. | 0.0012 | 0.013 | 2.5 |
| 17 | 0.0025 | 3.3 | 1.6 | 0.007 | 0.0015 | 0.0009 | 0.0012 | 0.0028 | 0.028 | Tr. | 0.0010 | 0.028 | 2.5 |
| 18 | 0.0024 | 3.3 | 0.8 | 0.007 | 0.0014 | 0.0010 | 0.0012 | 0.0026 | 0.030 | Tr. | 0.0011 | 0.030 | 2.9 |
| 19 | 0.0026 | 3.3 | 1.6 | 0.007 | 0.0015 | 0.0008 | 0.0013 | 0.0026 | 0.028 | Tr. | 0.0105 | 0.028 | 2.5 |

| Test Number | O content after final annealing (mass %) After removal of 10 μm from front and rear surfaces | Total sheet thickness | $W_{10/400}$ (W/kg) | $B_{50LC}$ (T) | Note |
|---|---|---|---|---|---|
| 8 | — | — | — | — | Comparative Example |
| 9 | 0.0029 | 0.0186 | 10.6 | 1.63 | Invention Example |
| 10 | 0.0029 | 0.0176 | 10.6 | 1.64 | Invention Example |
| 11 | — | — | — | — | Comparative Example |
| 12 | — | — | — | — | Comparative Example |
| 13 | 0.0028 | 0.0171 | 10.4 | 1.63 | Invention Example |
| 14 | — | — | — | — | Comparative Example |
| 15 | 0.0027 | 0.0180 | 12.5 | 1.62 | Comparative Example |
| 16 | 0.0028 | 0.0182 | 10.8 | 1.63 | Invention Example |
| 17 | 0.0027 | 0.0135 | 11.0 | 1.66 | Invention Example |
| 18 | 0.0026 | 0.0130 | 11.8 | 1.66 | Comparative Example |
| 19 | 0.0026 | 0.0130 | 13.5 | 1.62 | Comparative Example |

As for Test Number 8 in which the Si content was above the range of the present invention, Test Number 11 in which the Sn content was above the range of the present invention, Test Number 12 in which the amount of Sn+Sb was above the range of the present invention, and Test Number 14 in which the P content was above the range of the present invention respectively the specimen broke during the cold rolling, and thus the magnetic measurement was not possible. Test Number 15 in which the amount of sol. Al was above the range of the present invention and Test Number 19 in which the Ti content was above the range of the present invention were poor in the iron loss and the density of magnetic flux. Test Number 18 in which the Mn content was below the range of the present invention was poor in the iron loss. On the other hand, in Test Numbers 9, 10, 13, 16, and 17 in which the chemical compositions of the steel sheets were in the range of the present invention, the cold rolling was possible, and the iron losses and the densities of magnetic flux were excellent.

Experiment Example 3

Steel slabs containing a composition shown in Table 3 below with a remainder consisting of Fe and impurities were heated to 1,150° C. and then rolled to a thickness of 2.0 mm by hot rolling. Subsequently, the hot-rolled steel sheets were annealed in an annealing furnace of continuous annealing-type under conditions in which the soaking temperature was 1,000° C. and the soaking time was 40 seconds and then cold-rolled, thereby obtaining cold-rolled steel sheets having thickness of 0.25 mm. After that, with respect to these cold-rolled steel sheets, final annealing was carried out under conditions in which the soaking temperature was 800° C. and a soaking time was 15 seconds. After that, a solution including a phosphoric acid metal salt as main component and including an emulsion of an acrylic resin was further applied and baked to both surfaces of the steel sheets to form composite insulating coatings, thereby manufacturing non-oriented electrical steel sheets. Subsequently, on the obtained steel sheets, annealing for relieving stress of 750° C. for 2 hr was carried out.

Here, during the final annealing, for all of test numbers, the atmospheres of the temperature rising process and the soaking process were controlled to become an atmosphere of 15 volume % of $H_2$ and 85 volume % of $N_2$. The dew point was +10° C. In addition, the average temperature rising rate in the temperature rising process during the final annealing was set to 20° C./second, and the average cooling rate in the cooling process was set to 15° C./second. After the final annealing, the cold-rolled steel sheets were cooled to 200° C. or lower.

In Table 3, "Tr." indicates that the corresponding element was not added by intention. In addition, underlines indicate that values are not in the range of the present invention.

After that, for the respective manufactured non-oriented electrical steel sheets, the density of magnetic flux $B_{50}$ and the iron loss $W_{10/400}$ were evaluated using the Epstein method regulated in JIS C2550. The obtained results are summarized in Table 3.

TABLE 3

| Test Number | Composition of steel slab (mass %) | | | | | | | | | | | | |
|---|---|---|---|---|---|---|---|---|---|---|---|---|---|
| | C | Si | Mn | P | S | sol. Al | N | O | Sn | Sb | Ti | Sn + Sb | Si − 0.5 × Mn |
| 20 | 0.0027 | 3.6 | 2.7 | 0.008 | 0.0023 | 0.0012 | 0.0016 | 0.0025 | 0.016 | Tr. | 0.0019 | 0.016 | 2.3 |
| 21 | 0.0025 | 3.4 | 3.2 | 0.007 | 0.0023 | 0.0010 | 0.0015 | 0.0029 | 0.015 | Tr. | 0.0020 | 0.013 | 1.8 |
| 22 | 0.0026 | 3.6 | 2.7 | 0.008 | 0.0008 | 0.0013 | 0.0016 | 0.0026 | 0.015 | Tr. | 0.0021 | 0.015 | 2.3 |
| 23 | 0.0026 | 3.6 | 2.7 | 0.008 | 0.0100 | 0.0011 | 0.0017 | 0.0025 | 0.016 | Tr. | 0.0021 | 0.016 | 2.3 |
| 24 | 0.0023 | 3.8 | 1.5 | 0.007 | 0.0019 | 0.0008 | 0.0012 | 0.0033 | 0.025 | Tr. | 0.0012 | 0.025 | 3.1 |

| Test Number | O content after final annealing (mass %) | | $W_{10/400}$ (W/kg) | $B_{50LC}$ (T) | Note |
|---|---|---|---|---|---|
| | After removal of 10 μm from front and rear surfaces | Total sheet thickness | | | |
| 20 | 0.0027 | 0.0235 | 9.4 | 1.64 | Invention Example |
| 21 | 0.0029 | 0.0250 | 11.6 | 1.62 | Comparative Example |
| 22 | 0.0027 | 0.0232 | 9.2 | 1.64 | Invention Example |
| 23 | 0.0026 | 0.0228 | 11.8 | 1.62 | Comparative Example |
| 24 | 0.0033 | 0.0153 | 9.6 | 1.65 | Invention Example |

First, the magnetic properties of individual test numbers of Experiment Example 3 in which annealing for relieving stress was carried out were generally superior to the magnetic properties of the respective test numbers of Experiment Example 1 and Experiment Example 2 in which annealing for relieving stress was not carried out, and, particularly, Test Numbers 20, 22, and 24 in which the chemical compositions of the steel sheets were in the range of the present invention were excellent in the iron loss and the density of magnetic flux. On the other hand, Test Number 21 in which Si−0.5×Mn was below the range of the present invention was poor in the iron loss and the density of magnetic flux. In addition, Test Number 23 in which the S content was above the range of the present invention was poor in the iron loss and the density of magnetic flux than Test Number 20 or 22 in which the composition was almost the same except for S and which is in the scope of the present invention. As described above, it has been clarified that the non-oriented steel sheet according to the present invention exhibits excellent magnetic properties, even in a case where annealing for relieving stress is carried out.

Hitherto, the preferred embodiment of the present invention has been described in detail with reference to the accompanying drawings, but the present invention is not limited to the examples. It is clear that a person having ordinary skill in the art to which the present invention belongs is capable of devising a variety of modification examples or correction examples within the scope of technical concept described in the claims, and it is needless to say that such examples are also understood to be in the technical scope of the present invention.

INDUSTRIAL APPLICABILITY

According to the present invention, a non-oriented electrical steel sheet having favorable cold rollability and excellent magnetic properties and a method for manufacturing the same can be obtained, and thus the present invention is highly industrially available.

BRIEF DESCRIPTION OF THE REFERENCE SYMBOLS

10 NON-ORIENTED ELECTRICAL STEEL SHEET
11 BASE
**11*a*** SURFACE LAYER OXIDATION PORTION
**11*b*** BASE MATERIAL PORTION
13 INSULATING COATING

The invention claimed is:

1. A non-oriented electrical steel sheet comprising, as a chemical composition, by mass %, C: more than 0% and 0.0050% or less;
Si: 3.0% to 4.0%;
Mn: 1.0% to 3.3%;
P: more than 0% and less than 0.030%;
S: more than 0% and 0.0050% or less;
sol. Al: more than 0% and 0.0040% or less;
N: more than 0% and 0.0040% or less;
O: 0.0110% to 0.0350%;
Sn: 0% to 0.050%;
Sb: 0% to 0.050%;
Ti: more than 0% and 0.0050% or less; and
a remainder including Fe and impurities, wherein
Sn+Sb: 0.050% or less,
Si−0.5×Mn: 2.0% or more, and
an O content in a sheet thickness central portion excluding a surface layer portion which is a range from a front surface and a rear surface to a position of 10 μm in a depth direction is less than 0.0100%,
and wherein the O content of 0.0110% to 0.0350% represents an average O content in an entire base in a sheet thickness direction, including a surface layer oxidation portion.

2. A method for manufacturing a non-oriented electrical steel sheet, comprising:

hot rolling a steel ingot including, as a chemical composition, by mass %, C: more than 0% and 0.0050% or less, Si: 3.0% to 4.0%, Mn: 1.0% to 3.3%, P: more than 0% and less than 0.030%, S: more than 0% and 0.0050% or less, sol. Al: more than 0% and 0.0040% or less, N: more than 0% and 0.0040% or less, O: less than 0.0100%, Sn: 0% to 0.050%, Sb: 0% to 0.050%, Ti: more than 0% and 0.0050% or less, and a remainder including Fe and impurities, Sn+Sb: 0.050% or less, Si−0.5×Mn: 2.0% or more to produce a hot-rolled steel sheet;

annealing the hot-rolled steel sheet;

cold rolling the hot-rolled steel sheet after the annealing to produce a cold-rolled steel sheet; and final annealing the cold-rolled steel sheet, wherein, in the final annealing, a final annealing condition is controlled so that an average O content in the entire cold-rolled steel sheet in a sheet thickness direction after the final annealing becomes 0.0110 mass % to 0.0350 mass %, and in the final annealing, a dew point of an atmosphere during temperature rising and during soaking is controlled so as to be in a range of −10° C. to 40° C.

* * * * *